US007946436B2

(12) United States Patent
Laveault et al.

(10) Patent No.: US 7,946,436 B2
(45) Date of Patent: May 24, 2011

(54) BEVERAGE CONTAINER WITH THREADED PLASTIC DRINKING SLEEVE

(75) Inventors: Richard A. Laveault, Cheshire, MA (US); Stephen E. Stalions, Ft. Wayne, IN (US); Brian R. Law, Leicester (GB)

(73) Assignee: Rieke Corporation, Auburn, IN (US)

( * ) Notice: Subject to any disclaimer, the term of this patent is extended or adjusted under 35 U.S.C. 154(b) by 744 days.

(21) Appl. No.: 11/406,632

(22) Filed: Apr. 19, 2006

(65) Prior Publication Data

US 2007/0090078 A1 Apr. 26, 2007

Related U.S. Application Data

(63) Continuation-in-part of application No. 11/247,902, filed on Oct. 10, 2005, now abandoned.

(51) Int. Cl.

| | |
|---|---|
| ***B65D 1/46*** | (2006.01) |
| ***B65D 41/04*** | (2006.01) |
| ***B65B 7/28*** | (2006.01) |
| *B65D 41/34* | (2006.01) |

(52) U.S. Cl. ..... 215/42; 215/12.1; 215/12.2; 215/44; 215/252

(58) Field of Classification Search ..... 215/329–331, 215/42–44, 274, 321, 386, 252; 220/619, 220/641, 646, 288

See application file for complete search history.

(56) References Cited

U.S. PATENT DOCUMENTS

| | | | | |
|---|---|---|---|---|
| 2,157,891 | A * | 5/1939 | Godfrey | 222/519 |
| 3,603,472 | A | 9/1971 | Lecinski, Jr. et al. | 215/40 |
| 3,855,759 | A | 12/1974 | Pohlenz | 53/342 |
| 4,607,757 | A | 8/1986 | Lecinski | 215/246 |
| 4,853,063 | A | 8/1989 | Basgil et al. | 156/238 |
| 5,197,621 | A * | 3/1993 | Bartl et al. | 215/331 |
| 5,355,710 | A | 10/1994 | Diekhoff | 72/379.4 |
| 5,557,963 | A | 9/1996 | Diekhoff | 72/379.4 |
| 5,660,290 | A * | 8/1997 | Hayes | 215/252 |
| 5,713,235 | A | 2/1998 | Diekhoff | 72/352 |

(Continued)

FOREIGN PATENT DOCUMENTS

| | | |
|---|---|---|
| DE | 6903478 U | 5/1969 |

(Continued)

OTHER PUBLICATIONS

J. Langley, et al., "Understanding the Roll-On-Pilfer-Proof Process", Dept. of Mech. Eng., Univ. of Sheffield, UK and Tinsley Bridge Ltd., Sheffield, UK, 9 pgs.

(Continued)

*Primary Examiner* — Robin A. Hylton

(74) *Attorney, Agent, or Firm* — Woodard, Emhardt, Moriarty, McNett & Henry LLP

(57) ABSTRACT

A molded plastic drinking sleeve for push-on assembly to a neck portion of a container according to a typical embodiment includes an annular body formed by an annular sidewall having a uniform taper from a first open end to an opposite second open end, the annular sidewall defining an open interior. The annular sidewall further includes a series of external threads and a roller abutment at the base of the threads for stopping the roller equipment used to help fabricate a metal closing cap that is designed to thread onto the plastic drinking sleeve. The cooperating metal container that receives the drinking sleeve includes a portion that is curled over the upper edge of the drinking sleeve. A free edge of the curled portion is embedded into the plastic of the drinking sleeve.

4 Claims, 7 Drawing Sheets

U.S. PATENT DOCUMENTS

| | | | | |
|---|---|---|---|---|
| 5,718,352 | A | 2/1998 | Diekhoff et al. | 220/669 |
| 5,778,723 | A | 7/1998 | Diekhoff | 72/356 |
| 5,822,843 | A | 10/1998 | Diekhoff et al. | 29/512 |
| 5,881,907 | A | 3/1999 | Schutz | 220/644 |
| 6,010,026 | A | 1/2000 | Diekhoff et al. | 220/288 |
| 6,010,028 | A | 1/2000 | Jordan et al. | 220/669 |
| 6,105,807 | A | 8/2000 | McCrossen | 220/288 |
| 6,375,020 | B1 | 4/2002 | Marquez | 215/232 |
| 6,499,329 | B1 | 12/2002 | Enoki et al. | 72/348 |
| 6,543,636 | B1 | 4/2003 | Flecheux et al. | 220/288 |
| 6,565,349 | B1 | 5/2003 | Tanaka et al. | 425/307 |
| 6,779,677 | B2 | 8/2004 | Chupak | 220/288 |
| 6,783,486 | B1 | 8/2004 | Murakami | 493/140 |
| 6,857,304 | B2 | 2/2005 | Enoki | 72/348 |
| 2001/0040167 | A1 | 11/2001 | Flecheux et al. | 220/634 |
| 2004/0035871 | A1 | 2/2004 | Chupak | 220/608 |

FOREIGN PATENT DOCUMENTS

| | | | | |
|---|---|---|---|---|
| DE | 6903478 | U | * | 5/1969 |
| DE | 320712 | A1 | | 9/1983 |
| EP | 0654415 | A | | 5/1995 |
| FR | 2775206 | A | | 8/1999 |
| WO | WO 98/06636 | A | | 2/1998 |
| WO | WO 03/047991 | A1 | | 6/2003 |
| WO | WO 2004/024574 | A1 | | 3/2004 |
| WO | WO 2005/058716 | A1 | | 6/2005 |

OTHER PUBLICATIONS

European Search Report dated May 13, 2008 from EP 06254972.0.

* cited by examiner

BEVERAGE CONTAINER WITH THREADED PLASTIC DRINKING SLEEVE

CROSS REFERENCE TO RELATED APPLICATIONS

The present application is a continuation-in-part patent application of U.S. patent application Ser. No. 11/247,902, filed Oct. 10, 2005, entitled "BEVERAGE CONTAINER WITH THREADED PLASTIC DRINKING SLEEVE" which is hereby incorporated by reference in its entirety.

BACKGROUND OF THE INVENTION

The present invention relates in general to beverage containers of the type where the consumer may drink directly from the dispensing opening in the neck of the container. More specifically, the present invention relates to the addition of an externally-threaded, plastic drinking sleeve to the neck of the container to facilitate and improve the drinking experience.

As one example of the type of beverage container that is suitable for the plastic drinking sleeve of the present invention, consider a metal beer "bottle" with a screw-on, screw-off metal cap. Without the plastic drinking sleeve of the present invention, a consumer desiring to drink directly from the bottle would need to contact a threaded metal opening while drinking. Any exposed metal edges, roughness or burrs that might be left as part of the bottle or created from the interaction of the threaded metal closing cap and the bottle would be a concern. These features could create discomfort to the consumer and might force the consumer to dispense the contents from the container into another container before consuming. While this may not be a problem in some environments, beverages of this type are often consumed when no other container is available for the transfer of contents. Therefore, the addition of a plastic drinking sleeve, according to the present invention, improves the overall fit and feel of the finished product and the overall drinking experience.

By applying a threaded plastic sleeve to the neck of the bottle, any rough and/or exposed metal edges or burrs are either eliminated and/or covered with a smooth, molded plastic structure. The plastic sleeve is externally-threaded so as to receive the metal closing cap. As such, it is important that there be a secure seal so as to capture and hold the internal pressure for carbonated beverages. This requires that there be a close conforming fit and a tight threaded engagement between the plastic sleeve and the closing cap for a secure, leak-free interface, capturing and maintaining the internal pressure.

Whether during the capping procedure at the time of filling the container or at the time the closing cap is being removed (unscrewed) for the first time, it is essential that the plastic sleeve not loosen, slip, or turn (rotate) relative to the neck of the container. The plastic sleeve must be securely connected or anchored to the neck so that, once assembled, there is no relative motion between the plastic sleeve and the neck of the container. Even after the opening of the container, it is important that the plastic sleeve not loosen such that it turns or rotates relative to the neck of the container. The initial removal represents a higher torque situation due to breakage of the frangible elements of the closing cap. It is also important to have an assembly procedure for the plastic sleeve that is quick and simple, yet reliable and predictable.

The threaded plastic drinking sleeve of the present invention includes various structural features, characteristics and cooperative relationships, each of which contribute to some improvement or benefit or to some portion of an improvement or benefit of the overall closure assembly. The referenced closure assembly includes the container neck, the plastic sleeve, and the closing cap. The present invention is directed principally to the threaded plastic drinking sleeve and its fit and assembly relative to the container neck. An important aspect of the present invention is the embedding of part of the free edge of the metal neck directly into the plastic of the drinking sleeve. This interfit anchors and secures the drinking sleeve against turning or slippage during the removal of and during reclosing of the outer closing cap. This embedding step is performed after the upper portion (i.e., chimney) of the neck is curled over the top lip of the plastic drinking sleeve. Additionally, the nature of the threaded engagement between the closing cap and the threaded plastic drinking sleeve is important in that the contents, typically under pressure, must be captured without gas or liquid leakage. Finally, as part of one embodiment of the present invention, six tear drop-shaped, inwardly protruding bumps are molded as part of the inner surface of the sleeve. These bumps provide another securing featuring as they deform the metal of the neck.

BRIEF SUMMARY OF THE INVENTION

A plastic drinking sleeve for push-on assembly to a neck portion of a beverage container, according to one embodiment of the present invention, includes an annular body formed by an annular sidewall defining an open interior, the annular sidewall having an open first end and, opposite to the first end, an open second end and including a series of external threads, the annular sidewall further including an inner surface that is tapered to contact the neck portion with an interference fit as the plastic drinking sleeve is pushed onto the neck portion. The neck portion includes a free edge that is curled over an upper edge of the drinking sleeve and embedded into the plastic material of the drinking sleeve.

One object of the present invention is to provide an improved plastic drinking sleeve for a beverage container.

Other objects of the present invention include providing an improved plastic drinking sleeve and beverage container combination and the method of fabricating that combination.

Related objects and advantages of the present invention will be apparent from the following description.

DETAILED DESCRIPTION OF THE INVENTION

Figure 1:
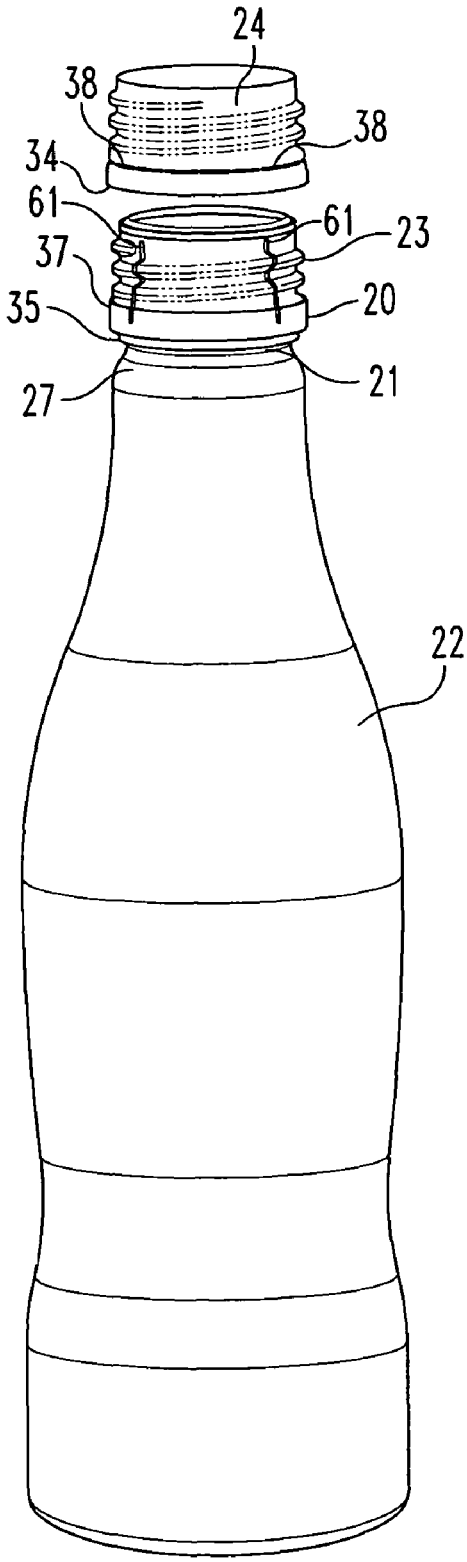
FIG. 1 is an exploded view of a beverage container including a plastic drinking sleeve and metal closing cap according to one embodiment of the present invention.
Figure 2:
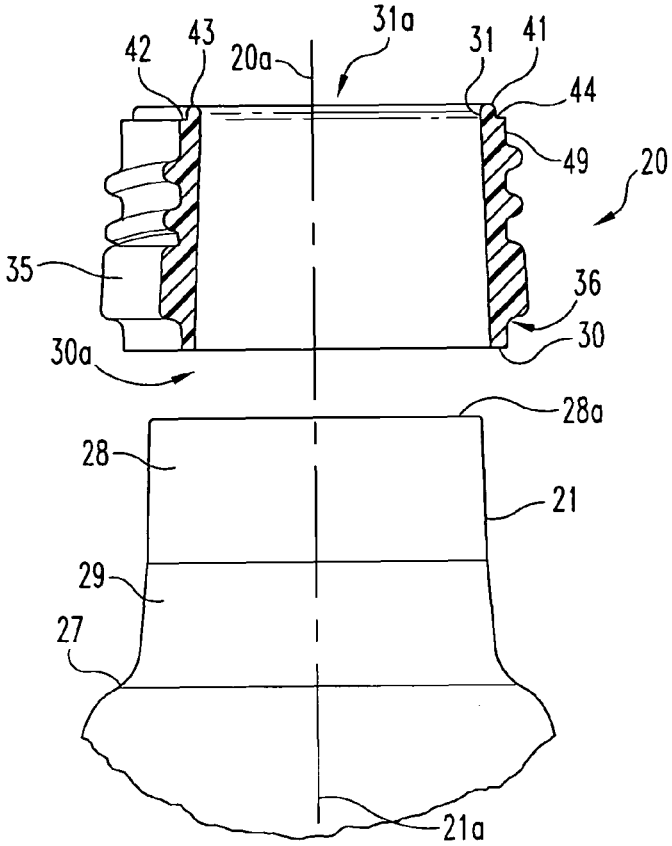
FIG. 2 is an exploded view of the plastic drinking sleeve and beverage container illustrating the first stage in their assembly sequence.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIGS. 1-5, there is illustrated a molded plastic drinking sleeve 20 that is securely attached to the annular neck 21 of a beverage container 22. In the illustrative embodiment of FIG. 1, the beverage container 22 is a metal beer "bottle" and plastic sleeve 20 is constructed and arranged to be permanently attached to the neck 21. The outer surface of sleeve 20 is externally threaded in the form of threads 23 for receipt of an internally-threaded metal closing cap 24.

In terms of the overall shapes and geometries, the container 22 can assume virtually any size and shape, but preferably there will be an annular abutment form such as shoulder 27 located at the bottom or base of the neck 21. Neck 21 is a hollow annular form with two adjoining frustoconical portions 28 and 29. While the normal or prior art style of neck profile is typically a straight conical (frustoconical) profile, this particular shape is limited to upper portion 28. Lower portion 29 has been changed according to the present invention by being slightly flared in a radially outward direction. This change results in portion 29 having a greater cone angle, as measured at the apex compared to the cone angle of portion 28. Neck 21, including portions 28 and 29, is circumferentially symmetrical about its axial centerline 21*a*.

The plastic drinking sleeve 20 is a hollow, generally annular form with external threads 23. Sleeve 20 is a unitary, molded plastic structure that can be fabricated from a suitable material based upon the container contents and compatibility with the metal of the container and the metal of the closing cap. The longitudinally opposite ends 30 and 31 each define a generally circular opening 30*a* and 31*a*, respectively. Sleeve 20 is circumferentially symmetrical about axial centerline 20*a* and when sleeve 20 is properly installed on the container neck 21, axial centerlines 20*a* and 21*a* should generally coincide.

The closing cap 24 is an annular metal component that is internally threaded and provided with a frangible ring 34 at its base that locks onto the lower portion 33 of plastic drinking sleeve 20. Once the closing cap 24 is securely (initially) tightened onto sleeve 20 at the time of filling, ring 34 locks beneath radial lip 35 into annular recess 36. Retrograde turning of closing cap 24 so as to axially move closing cap 24 upwardly off of sleeve 20 causes ring 34 to abut up against the underside surface 37 of radial lip 35. This abutment prevents further upward travel of ring 34 and with continued counterclockwise turning of closing cap 24 (unthreading), the frangible elements 38 that connect ring 34 to the remainder of closing cap 24 fracture, leaving ring 34 in recess 36 between surface 37 and shoulder 27 and permitting the closing cap 24 to be removed from sleeve 20.

With continued reference to FIGS. 1-5, the structural details of plastic drinking sleeve 20 will be described, including its installation procedure and sequence so as to secure the sleeve 20 onto the neck 21 of container 22. Drawing FIGS. 6 through 9 describe further structural features of sleeve 20 including its cross-sectional form. In FIG. 9, a portion of the neck 21 is included so as to show the embedding of the metal of the neck 21 into the plastic of the sleeve 20.

One aspect of the overall construction of plastic drinking sleeve 20 is that it is constructed and arranged to press onto or push onto neck 21 with a certain degree of dimensional interference between the inside of the plastic drinking sleeve 20 and the outside of the neck 21 of the container 22 that contributes to part of the overall secure fit between these two components. This degree of dimensional interference has at least two effects in terms of the sleeve and container combination. First, there is some degree of dimensional expansion to the outer surface of plastic sleeve 20 as it is pressed on or pushed onto the neck 21. It is estimated that there is approximately an 8 percent size expansion of the outer profile of the sleeve 20. This dimensional expansion affects the thread size in terms of the thread major diameter and the thread minor diameter. There is a size difference (8 percent) between the free dimensions prior to installation (see FIG. 2) and the dimensions after the sleeve is pressed onto the neck (see FIG. 3). In order to compensate for the dimensional expansion that is experienced as the plastic sleeve is pushed onto the neck with an interference fit, the present invention specifically configures the molded plastic external threads to the small side, dimensionally. This smaller or scaled-down starting size for the plastic sleeve threads, as initially molded and prior to assembly (see FIG. 2), results in the threads 23 being able to expand to the desired final dimension in terms of the thread major diameter and the thread minor diameter, once the sleeve 20 is completely pushed onto the neck 21 of container 22 (see FIG. 3). There is in effect a first thread major diameter and a first thread minor diameter prior to assembly of sleeve 20 (see FIG. 2) and then larger second thread major and minor diameters after assembly (see FIG. 3). Secondly, the degree of dimensional interference influences how tightly the sleeve 20 fits onto the neck 21 as the sleeve 20 is pushed onto the neck.

It has been learned that a press fit or interference fit alone, between the sleeve 20 and neck 21, may not be sufficient under all conditions to prevent slippage or rotation of the sleeve 20 as the closing cap 24 is removed (unscrewed) and reapplied to the sleeve 20 to close the container. For example, under certain temperature fluctuations or variations, the different coefficients of thermal expansion and contraction between metal and plastic can loosen the interference fit between the sleeve 20 and the neck 21. If the degree of interference fit is increased in order to try and solve this particular problem, it is anticipated that it will be more difficult to press the sleeve 20 onto the neck 21 without creating undesirable distortion of the sleeve or damage to the sleeve. While some degree of interference fit is desirable, having another structural interfit or connection between the sleeve 20 and neck 21 is believed to be beneficial, if not necessary, in order to achieve the requisite anchoring of the sleeve 20 to the neck 21 so that the sleeve 20 does not turn, slip, or rotate during use.

In order to achieve this additional structural connection, i.e., anchoring, of sleeve 20 to neck 21, the upper part of the upper portion 28 is first curled over the top lip or edge 41 of the plastic drinking sleeve 20 as part of a forming and shaping operation. This upper portion defines the neck opening and includes a free edge 28*a*. The upper portion 28 is then drawn down in the direction of radial shelf 42 so as to position free edge 28*a* adjacent the radial shelf 42. The top edge 41 of the sleeve 20 includes an upwardly extended or raised, rounded annular rib 43 as detailed in FIG. 9. The shelf 42 is adjacent the base of rib 43 and surrounds rib 43. The shelf 42 is substantially horizontal with the container in an upright position. The assembly equipment used to assemble and connect the sleeve to the neck applies a downward axial force ($F_A$) on the top of curled-over portion 28 and an inward radial force ($F_R$), (see FIGS. 5 and 9). This inward radial force is directed to the free edge 28*a* and the result that is achieved is to embed at least part of the free edge 28*a* into the plastic material of the sleeve 20, see FIGS. 1 and 5. This embedding of metal into plastic creates a secure connection that anchors the sleeve 20 to the neck 21 such that the sleeve 20 is not allowed to turn, twist, or rotate relative to the neck. The structural combination that is described physically pushes at lest part of the metal edge of the container neck into the body of plastic adjacent the corner junction 44 between the upper raised rib 43 and the radial shelf 42. The free edge 28*a* has a generally rectangular shape in cross section. This geometry includes an inside annular corner 45 and an outside annular corner 46. The embedding of edge 28*a* into the plastic material of the sleeve 20 results in corner 45 being embedded into the base of rib 43 and corner 46 being embedded into radial shelf 42.

While the original objective of the embedding step of the metal into the plastic was to securely anchor the sleeve to the neck to prevent any relative turning, slipping, or rotation, additional benefits have been realized as a result of this connection method and structure. First, the free edge 28*a* is now captured and encased in plastic. If top portion 28 is merely curled over the top edge 41 of sleeve 20 so as to try and conform to the rounded shape of rib 43, then the free edge 28*a* is directed at shelf 42. Without the embedding step, the free edge 28*a* remains exposed. This then exposes outside corner 46 and permits the user to contact this annular corner edge 46 while drinking. Embedding of free edge 28*a* into the plastic material of sleeve 20 prevents having any exposed corner edge.

Secondly, without the embedding step, the free edge 28*a* has the ability to flex outwardly over time. Whether attributable to spring back of the curled over metal or whether due to differences in the thermal coefficients, or whether due to simply use and handling, the possibility exists. If the radial width of shelf 42 exceeds the wall thickness of portion 28, then presumably the initial fabrication will inset free edge 28*a* radially inside of outer surface 49 of sleeve 20. While this may lessen the risk of user contact with corner edge 46, at least initially, there is nothing to prevent portion 28 from deflecting outwardly. This then could push corner edge 46 beyond surface 49, creating an unacceptable condition due to the presence of the protruding corner edge 46.

Further, without the embedding step there is a seam or separation gap between the end surface 50 of free edge 28*a* and the upper surface 51 of radial shelf 42. This separation creates a collection trap for debris that is difficult to wipe away since it can work its way up into the interface between rib 43 and portion 28. In order to help prevent this problem, other manufacturers have elected to introduce the added step of applying some coating or sealant. This added step represents an expenditure of time and money that is not required with the structure proposed by the present invention.

Figure 3:
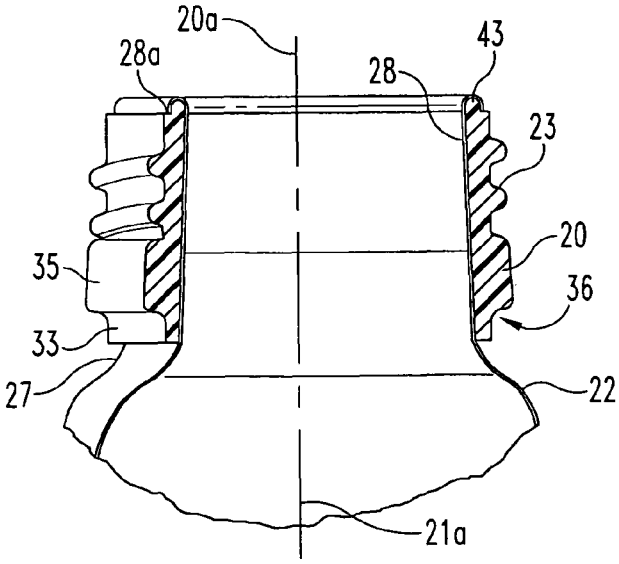
FIG. 3 is a front elevation view, in partial section, of the FIG. 2 plastic drinking sleeve and container neck combination illustrating the second stage in the assembly procedure.

Referring to FIGS. 2-5, the installation or assembly sequence of the plastic sleeve 20 onto neck 21 is illustrated in four steps or stages. Beginning or starting with the illustration in FIG. 2, the neck 21 of the container is presented for receipt of the unitary, molded plastic drinking sleeve 20 which goes to the neck by axial movement (push-on) including a sliding interference fit of sleeve 20 onto neck 21. In FIG. 3, the sleeve 20 is pushed onto the neck 21 and the sizes, shapes, and contours of the sleeve engage the upper and lower frustoconical portions 28 and 29, respectively. As previously described, the lower portion 29 has a slightly flared profile and this shape creates added interference to the aforementioned dimensional interference as the sleeve 20 begins to encounter lower portion 29.

Figure 4:
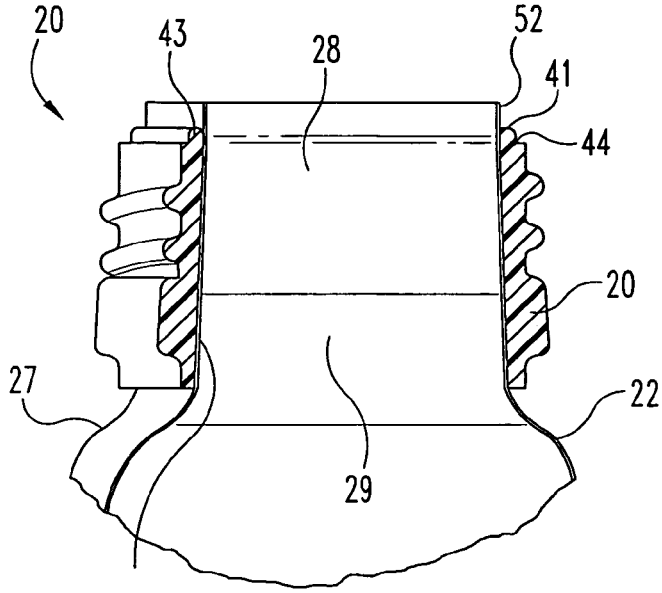
FIG. 4 is a front elevation view, in partial section, of the plastic drinking sleeve and container neck combination showing the third stage in the assembly procedure.

As illustrated in FIG. 4, continued force or pressure in an axial direction on sleeve 20 pushes it fully onto neck 21 into a fully assembled condition with regard to the axial position between the two. In this condition, the lower end 30 of sleeve 20 approaches shoulder 27 and will preferably contact shoulder 27. The fully assembled condition of sleeve 20 onto neck 21, as illustrated in FIG. 4, leaves annular chimney portion 52 of neck 21, axially extending above or beyond the upper end 41 of sleeve 20. Annular chimney portion 52 is then formed over and around raised annular rib 43 (see FIG. 5) with the free edge 28*a* directed toward and in close proximity to the radial shelf 42 and adjacent corner junction 44. If the assembly and connection steps would stop here, then this formed-over configuration would cooperate with the interference fit to prevent any upward axial travel of sleeve 20 relative to neck 21. Any downward axial travel of sleeve 20 relative to neck 21 is prevented in part by shoulder 27 and in part by the interference fit of plastic sleeve 20 onto neck 21.

Figure 5:
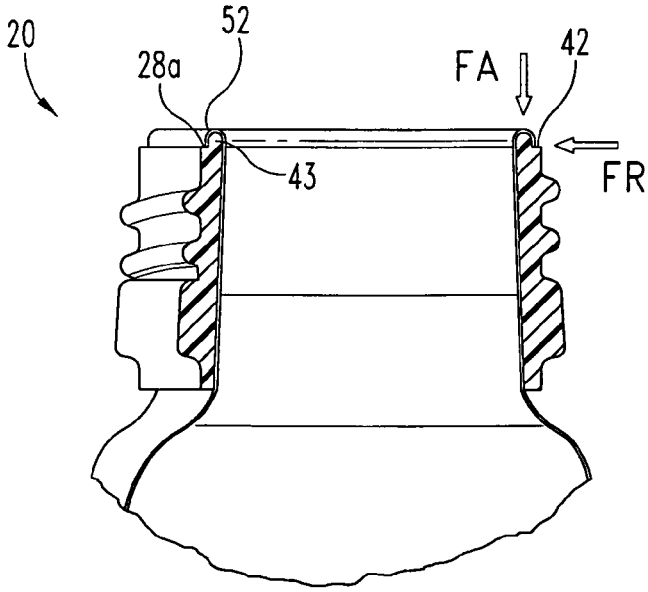
FIG. 5 is a front elevation view, in partial section, of the plastic drinking sleeve and container neck combination showing the fourth and final stage of the assembly procedure.

However, the assembly and connection steps do not stop with simply curling the chimney portion 28 over and around raised annular rib 43. The present invention includes the additional step of embedding at least a portion of the metal free edge 28*a* directly into the plastic material of sleeve 20. In order to perform this step, a downward axial force $F_A$ is applied to the formed over or curled portion (uppermost) of portion 28, as shown in FIG. 5. Concurrently, an inward radial force $F_R$ is applied to the free edge 28*a*. These two forces cooperate to embed inside corner 45 into the base of the raised annular rib 43, directly above the corner junction 44. These two forces also cooperate to embed outside corner 46 into the radial shelf 42. The described embedding is more than simply surface contact that might distort the plastic without actually penetrating the plastic. Instead, the described embedding actually causes the annular corner edges 45 and 46 to dig into the plastic material of the sleeve 20 at the two described locations, see FIG. 9. The free edge 28*a* that includes end surface 50 extending between corners 45 and 46 has a wall thickness of approximately 0.016 inches (0.406 mm).

Figure 6:
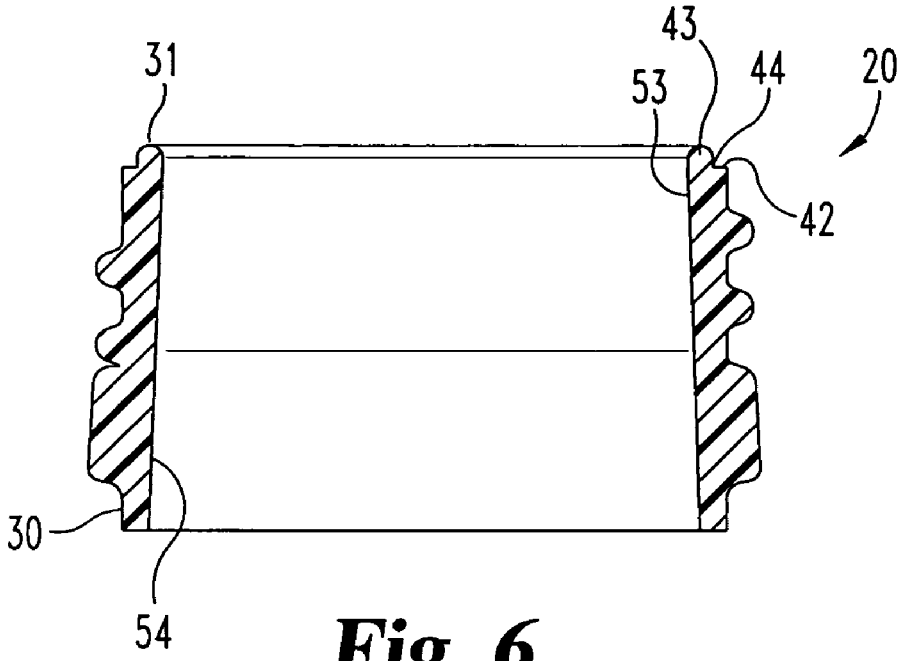
FIG. 6 is a front elevation view, in full section, of the FIG. 1 plastic drinking sleeve.

Referring now to FIG. 6, the plastic sleeve 20 is illustrated in full section form to help show the specific geometry of the various portions and sections and their spatial and functional relationships. The inner surface 53 includes a tapered portion extending downwardly from upper end 31 to lower end 30. One omitted feature of note is that there is no lead-in chamfer in area 54 as would normally be seen or expected around lower end 30. The angle of taper for the inner surface 53 from end 31 to end 30 is preferably 1½ degrees, but the present invention contemplates that a suitable taper can range from 1 degree up to 2 degrees. The direction of taper is outwardly diverging from end 31 to end 30. This taper provides adequate clearance to forego the need for any lead-in chamfer. By omitting any lead-in chamfer adjacent lower end 30, additional surface contact area is provided as part of the inner surface 53 of sleeve 20 for more complete engagement of the sleeve inside surface against the outer surface of neck 21. It is envisioned that having more surface area contact between sleeve 20 and neck 21 will assist in holding sleeve 20 in place on neck 21. The primary anchoring of the sleeve 20 onto the neck 21 so as to prevent sleeve 20 turning or rotating relative to neck 21 is achieved by the embedding step. By preventing any turning or rotation of the sleeve 20 relative to neck 21, the closing cap 24 can be properly threaded onto and off of the sleeve 20 without also turning or rotating the sleeve 20 on the neck 21. This means that the closing cap 24 can be fully tightened as part of the filling and capping procedures in order to properly close the container and seal in the contents. When the closing cap 24 is to be removed from the sleeve 20, whether the first time in order to sever the frangible ring 34 or subsequently while the contents are being consumed, the closing cap 24 accurately tracks the external threads 23 without any slippage between the sleeve 20 and neck 21.

Figure 7:
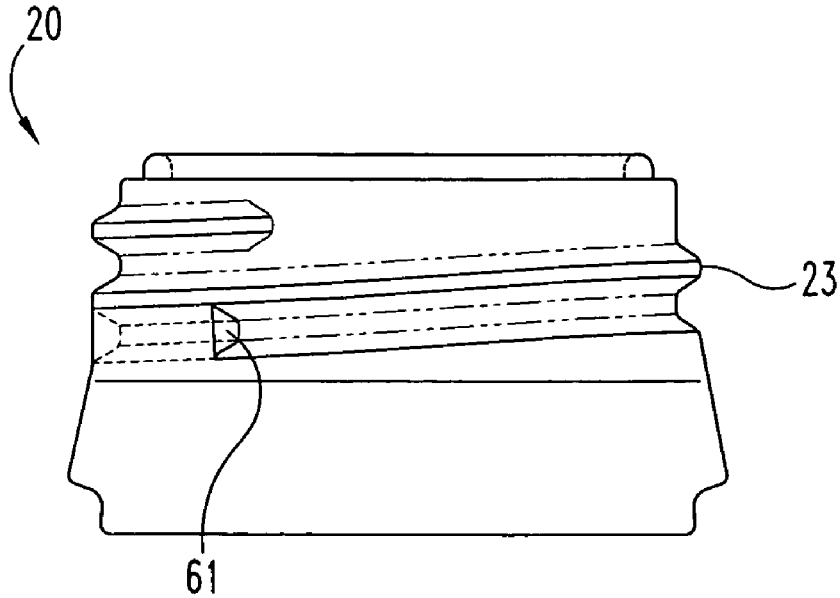
FIG. 7 is a front elevation view of the FIG. 1 plastic drinking sleeve.
Figure 8:
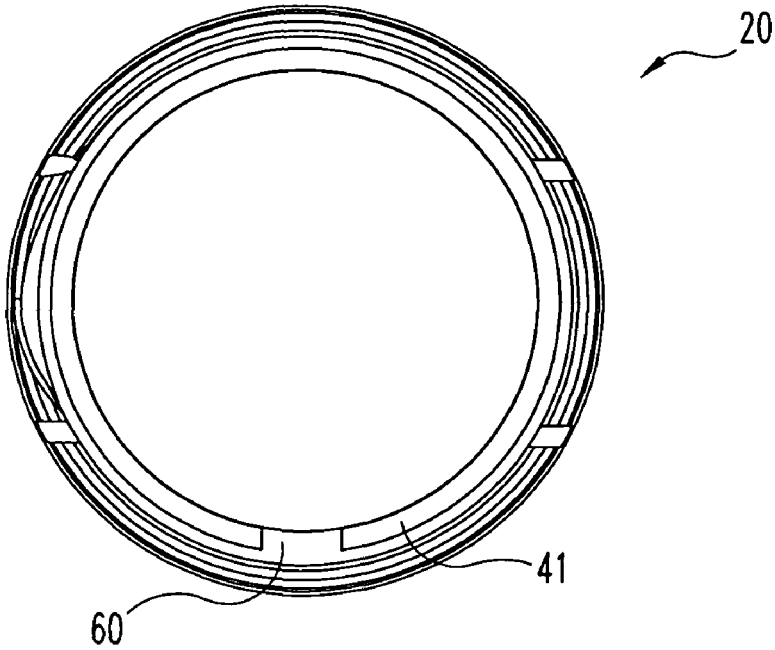
FIG. 8 is a top plan view of the FIG. 1 plastic drinking sleeve.
Figure 9:
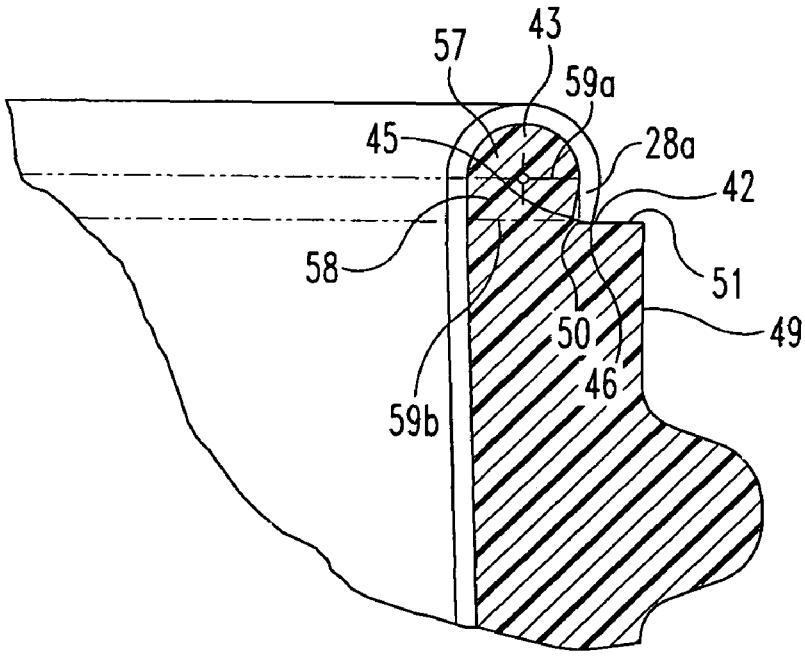
FIG. 9 is an enlarged, partial, front elevational view, in full section, of an annular upper rib comprising a portion of the FIG. 1 plastic drinking sleeve.

With continued reference to FIG. 6 and with added reference to FIGS. 7-9, additional details of plastic sleeve 20 are illustrated. The upper lip of sleeve 20 that is described as top edge 41 includes the raised annular rib 43 and the radial shelf 42. In the section views of FIGS. 6 and 9, the rib 43 has a generally semi-circular upper portion 57 and a generally rectangular lower portion 58. Broken lines 59*a* and 59*b* provide the dividing or boundary lines for portions 57 and 58. Upper portion 57 has a radius of approximately 0.020 inches (0.508 mm). The generally rectangular form of lower portion 58 measures approximately 0.040 inches (1.016 mm) by 0.016 inches (0.406 mm). With respect to axial centerline 20*a*, shelf 42 is substantially horizontal when centerline 20*a* is vertical. The radial width of shelf 42 is approximately 0.023 inches (0.584 mm). The notch 60 in top edge 41 is provided for gating of the mold. Slots 61 are provided for venting of the gas from within the container at the time of removing the closing cap 24. The cross section of FIG. 9 is described as an axial cross section since the cutting plane is parallel to the axial centerline 20*a*.

The capping procedure for the disclosed combination involves the automated (threaded) assembly of the closing cap 24 onto sleeve 20. The initial assembly of the closing cap 24 includes seating of the frangible ring 34 portion into the annular recess 36 below radial lip 35. One of the realities of structures of this type in terms of the sleeve 20 and closing cap 24 is the need for the thread pitches to be closely matched for the best fit and a securely connected, tightly sealed interface. The technique that is used is to use tracking rollers to trace the threads on the sleeve by pushing against a closing cap preform and thereby control the fabrication of the closing cap 24 based on the thread specifics. In this manner, whatever expansion or reshaping of the sleeve 20 takes place when the sleeve is assembled onto the container neck, these variables will be considered and utilized in fabricating a "matching" closing cap. The variations that might occur from one assembled sleeve 20 to another are read by the tracing or tracking roller and translated into the sizing and shaping of the cooperating threads of the metal closing cap 24. This procedure creates a closer and better fitting metal closing cap 24 that is specifically matched for a corresponding plastic sleeve 20.

One of the concerns with the presently available tracking roller equipment is that the tracking or tracing rollers continue to travel even after the profile of the threads has been traced and the threads on the closing cap formed. This roller equipment continues to run even after tracing the threaded profile, even though no new shape information is being generated. As a result, there is a time and equipment utilization inefficiency. More specifically, in the manufacturing process directed to creating and applying the metal closing cap 24, the cap begins as a metal form or preform that needs to be properly sized and shaped in order to conform to the neck of the container, in this case, it needs to be conformed to the neck, as fitted with plastic sleeve 20. The closing cap 24 will ultimately end up as an internally-threaded component, but initially the metal preform is not threaded. The threads are created by conforming that metal preform to the size and shape of the external threads of plastic sleeve 20. Ideally the threads on the closing cap 24 will be sized and shaped to closely conform to the external threads on the plastic sleeve. This is virtually guaranteed by using the size, shape, and threaded form of the plastic sleeve profile as the mandrel for shaping the metal closing cap. With use of the plastic sleeve as a shaping mandrel, there is a high degree of correspondence and a better fit and function for the finished closing cap 24 as it fits onto threaded plastic sleeve 20.

Since the plastic sleeve 20 can vary or change slightly as part of the plastic molding process and since it can change again when pushed onto the neck 21 of container 22, using the plastic sleeve profile as a mandrel helps to "match" the closing cap being fabricated with the plastic sleeve that receives the cap. This higher degree of conformance or correspondence helps to ensure a tightly closed combination that provides the requisite sealing. This closing cap-to-plastic sleeve fit also helps to ensure that the frangible ring 34 will separate properly and that the closing cap 24 will not become a "spinner". The term "spinner" is used for closures that do not break the frangible ring when twisted off. The same term is used to describe closures that have been turned the wrong way (i.e., clockwise) on opening, stripping the thread while not breaking the frangible ring.

The closing cap fabrication and the subsequent capping process or procedure for roll-on-pilfer-proof (ROPP) closures (i.e., closing cap 24) is a high-speed event. A typical production line provides a capping head that is lowered automatically over the metal preform of the closing cap as it is positioned over the plastic sleeve 20. A pressure is applied that creates a seal between the sleeve and any cap liner material.

As the capping head rotates, a spring pivot system causes the equipment rollers to move inwardly. These rollers engage the outer surface of the metal preform for closing cap 24 and push the metal inwardly as the rollers track the threaded form of the plastic sleeve that was pushed onto the neck 21 of container 22. The forming of the metal of the closing cap preform, using the plastic sleeve 20 as a mandrel, creates the necessary threaded form for the closing cap 24 that precisely matches and closing conforms to that particular plastic sleeve. The published paper entitled "Understanding The Roll-On-Pilfer-Proof Process" by J. Langley, Dr. A. Yoxall, and Prof. John Yates of the Department of Mechanical Engineering, The University of Sheffield, UK, and P. Taylor of Tinsley Bridge Ltd., Sheffield, UK, provides a discussion of this process.

As described, the capping equipment does not have the "intelligence" to stop the rollers from continuing to roll around the exterior of the closing cap once the threaded form is created and the capping completed.

It would therefore be an improvement to this fabrication and capping process to modify the roller equipment to eliminate or reduce these inefficiencies. The present invention though approaches a solution to this issue not by modifying the roller equipment, but instead by incorporating into the external threads 23 of sleeve 20 a stop in the form of a roller abutment 61. This roller abutment or stop 61 is unitarily formed at the base of the external threads 23 on a minor diameter surface. As the roller encounters this abutment 61, the roller travel stops. There is no continued movement of the roller and no time or equipment utilization inefficiency as a result of adding the thread stop 61 for roller abutment.

The roller abutment 61 has a half-moon shape and functions as a door stop to the roller travel. As the tracing or tracking roller would otherwise keep spinning, this roller abutment 61 provides a stopping point and further provides a better looking capped assembly.

Figure 10:
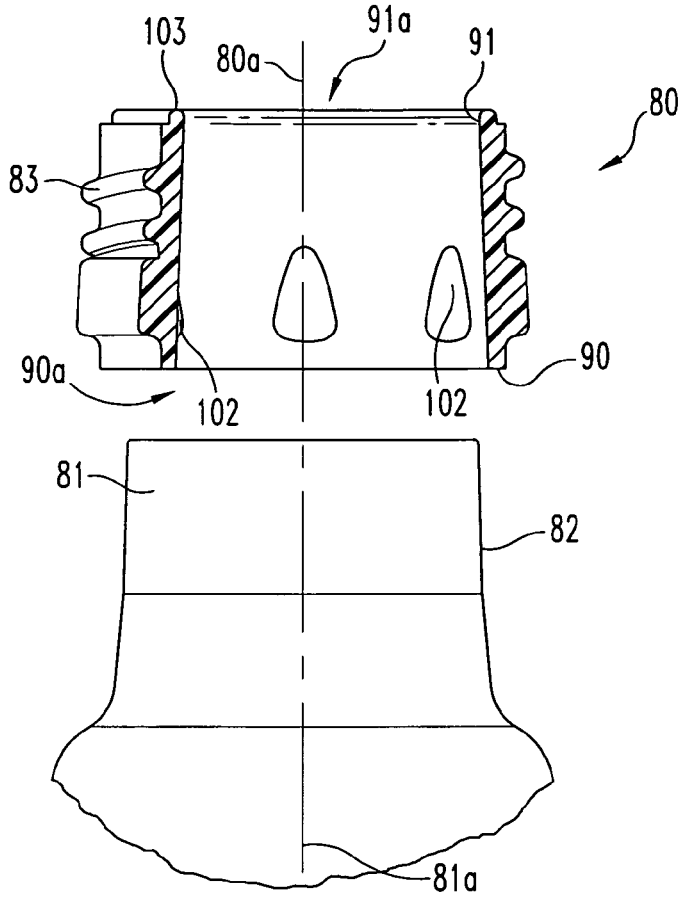
FIG. 10 is an exploded view of another embodiment of a plastic drinking sleeve and beverage container according to the present invention.
Figure 11:
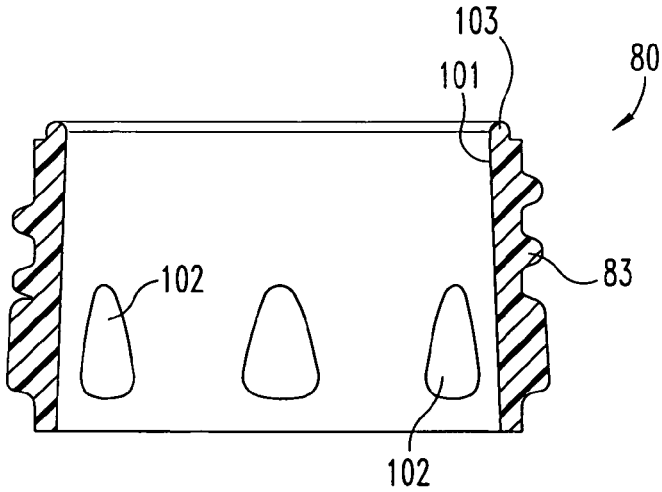
FIG. 11 is a front elevational view, in full section, of the FIG. 10 plastic drinking sleeve.

With reference to FIGS. 10 and 11, there is illustrated another embodiment of a molded plastic drinking sleeve 80 according to the present invention. Sleeve 80 is constructed and arranged to be securely attached to the annular neck 81 of a beverage container 82. The outer surface of sleeve 80 is externally threaded in the form of threads 83 for receipt of an internally-threaded metal closing cap 84 (see FIG. 12).

Plastic drinking sleeve 80 is a unitary, molded plastic structure having a hollow, generally annular form. Sleeve 80 can be fabricated from a variety of different plastic materials that are suitable for the container contents and compatible with the metal of the container 82 and the metal of the closing cap 84. In the preferred embodiment, the selected plastic material for sleeve 80 is PET. This material is preferred due to its harder nature as compared to a plastic material such as HDPE. The harder PET material is also suitable as a material for plastic drinking sleeve 20. The selected composition should be a bottle resin grade.

The longitudinally opposite ends 90 and 91 of sleeve 80 each define a generally circular opening 90*a* and 91*a*, respectively. In terms of the present invention, the plastic drinking sleeve 80 includes two interior features and three exterior features that can be used together, separately, or in any combination of two or three or four as disclosed herein as part of the present invention. While these various features cooperate to provide an improved plastic sleeve, these features individually provide a benefit or improvement, albeit less than what all together would contribute as a cooperative group. Sleeve 80 is circumferentially symmetrical about axial centerline 80*a* and, when sleeve 80 is properly installed on the container neck 81, axial centerlines 80*a* and 81*a* should generally coincide.

The closing cap 84 is virtually identical in form, fit, and function to closing cap 24. The description of closing cap 24 relative to sleeve 20 and container 22 is the same as the description for closing cap 84 relative to sleeve 80 and container 82.

A first aspect of the overall construction of plastic drinking sleeve 80 is that is presses onto or pushes onto neck 81 and there is a certain degree of dimensional interference between the plastic drinking sleeve 80 and the neck 81 of the container 82 that contributes to the overall secure fit between these two components. This degree of dimensional interference has at least two effects in terms of the sleeve and container combination. First, there is some degree of dimensional expansion to the outer surface of plastic sleeve 80 as it is pressed on or pushed onto neck 81. It is estimated that there is approximately an eight percent (8%) size expansion of the outer profile of the sleeve 80. This dimensional expansion affects the thread size in terms of the thread major diameter and the thread minor diameter. There is a size different (eight percent) between the free dimensions prior to installation and the dimensions after the sleeve 80 is pressed onto the neck. In order to compensate for the dimensional expansion that is experienced as the plastic sleeve is pushed onto the neck with an interference fit, the present invention specifically configures the molded plastic external threads to the small side dimensionally. This smaller or scaled-down starting size for the plastic sleeve threads, as initially molded and prior to assembly, results in the threads 83 being able to expand to the desired final dimension in terms of the thread major diameter and the thread minor diameter, once the sleeve 80 is fully and property installed onto neck 81 of container 82. There is in effect a first thread major diameter and first thread minor diameter prior to assembly of sleeve 80 and then larger second thread major and minor diameters after assembly.

Secondly, the degree of dimensional interference influences how tightly the sleeve 80 fits onto the neck 81 as the sleeve 80 is pushed onto the neck. In order to enhance the tightness and security of the sleeve-to-neck connection, the inner surface 101 of the plastic sleeve 80 is molded with an equally-spaced series of six (6) tear drop-shaped raised projections or bumps 102. These bumps extend away from inner surface 101 in a radially inward direction toward axial centerline 80*a*.

Figure 12:
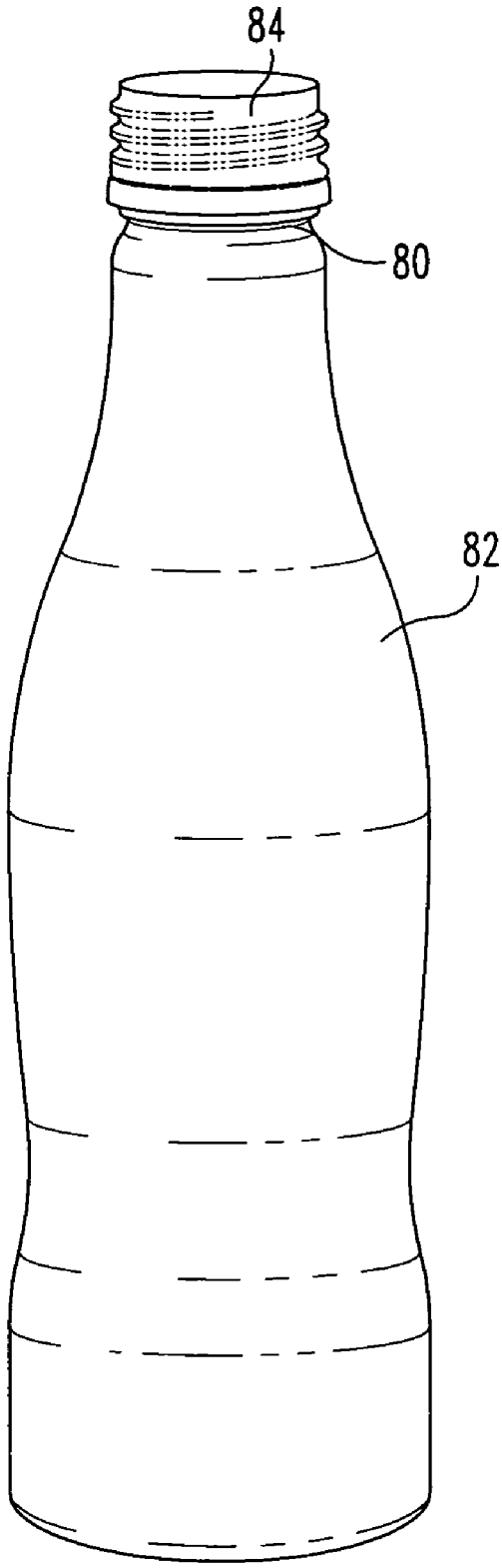
FIG. 12 is a front elevational view of the FIG. 10 plastic drinking sleeve and beverage container, as assembled with a closing cap.

Further, the presence of these bumps 102, noting the use of a harder plastic (i.e., PET), means that these bumps 102 push in and deform the metal of the neck in the form of spaced-apart indentations as the sleeve 80 is pushed onto the neck 81 with an interference fit. The final assembly of sleeve 80 onto container 82 and closing cap 84 onto sleeve 80 is illustrated in FIG. 12.

Considering only the rounded annular rib 43 and 103 and the raised (radially inwardly extending) bumps 102, it is envisioned that, as part of the present invention, a suitable plastic drinking sleeve would include, with or without all of the other features as disclosed herein, at least either the rib 43 (103), or the bumps 102, or both of these features working together in combination.

The assembly steps and their sequence for the assembly of sleeve 80 onto neck 81 of container 82 are substantially the same as the steps described in conjunction with sleeve 20, including the use of rounded annular rib 103, similar to rib 43, and the curling of the metal of the chimney as described in conjunction with the first embodiment. The only structural difference in terms of what occurs in the sequence of assembly steps between sleeve 80 and sleeve 20 is that sleeve 80 includes the six (6) tear drop-shaped raised projections or bumps 102.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. In combination:

a container including a neck portion which is constructed and arranged to receive a plastic drinking sleeve, said neck portion having a generally frustoconical wall section; and a plastic drinking sleeve which is constructed and arranged to be assembled onto said neck portion with an interference fit, said plastic drinking sleeve having a sidewall with an open first end, said sidewall being formed with external threads, said external threads having a thread major diameter and a thread minor diameter, said sidewall having a generally frustoconical inner surface, wherein the relative dimensional sizing of said generally frustoconical wall section and of said generally frustoconical inner surface results in said interference fit and wherein said thread major diameter and said thread minor diameter each having a first size prior to assembly of said plastic drinking sleeve onto said neck portion and a second size following assembly of said plastic drinking sleeve onto said neck portion, wherein said second size is larger than said first size due to said interference fit which expands said plastic drinking sleeve, wherein said neck portion includes a free edge that is formed over a portion of said sidewall adjacent said open first end, a part of said free edge being embedded into said plastic drinking sleeve.

2. The combination of claim 1 wherein said second size of said thread major diameter is approximately eight percent (8%) larger than said first size of said thread major diameter and wherein said free edge, prior to being embedded into said plastic drinking sleeve, has a generally rectangular shape in cross section.

3. In combination:

an internally-threaded closing cap including a body portion and a frangible ring which is connected to said body portion by frangible elements;

a container including a neck portion which is constructed and arranged to receive a plastic drinking sleeve, said neck portion having a generally frustoconical wall section; and a plastic drinking sleeve which is constructed and arranged to be assembled onto said neck portion with an interference fit, said plastic drinking sleeve having a sidewall with an open first end, said sidewall being formed with external threads which are constructed and arranged to threadedly receive said closing cap, said external threads having a thread major diameter and a thread minor diameter, said sidewall having a generally frustoconical inner surface, wherein the relative dimensional sizing of said generally frustoconical wall section and of said generally frustoconical inner surface results in said interference fit and wherein said thread major diameter and said thread minor diameter each having a first size prior to assembly of said plastic drinking sleeve onto said neck portion and a second size following assembly of said plastic drinking sleeve onto said neck portion, wherein said second size is larger than said first size due to said interference fit which expands said plastic drinking sleeve, wherein said neck portion includes a free edge that is formed over a portion of said sidewall adjacent said open first end, a part of said free edge being embedded into said plastic drinking sleeve, wherein said plastic drinking sleeve includes a radial lip and defines a recess adjacent said radial lip, said frangible ring being received in said recess and being constructed and arranged for abutment against said radial lip in response to unthreading of said closing cap from said plastic drinking sleeve.

4. The combination of claim 3 wherein said second size of said thread major diameter is approximately eight percent (8%) larger than said first size of said thread major diameter and wherein said free edge, prior to being embedded into said plastic drinking sleeve, has a generally rectangular shape in cross section.

* * * * *